US005400125A

United States Patent [19]

Stuerzer et al.

[11] Patent Number: 5,400,125

[45] Date of Patent: Mar. 21, 1995

[54] TRANSFER STATION WITH PRESSURE ELEMENT FOR AN ELECTROGRAPHIC PRINTER OR COPIER MEANS

[75] Inventors: Anton Stuerzer, Grafing; Rainer Koefferlein, Munich, both of Germany

[73] Assignee: Siemens Aktiengesellschaft, Munich, Germany

[21] Appl. No.: 155,636

[22] Filed: Nov. 22, 1993

[30] Foreign Application Priority Data

Oct. 1, 1993 [DE] Germany ..... 9314937 U

[51] Int. Cl.[6] ..... G03G 15/16

[52] U.S. Cl. ..... 355/274; 355/277

[58] Field of Search ..... 355/274, 277, 299, 271

[56] References Cited

U.S. PATENT DOCUMENTS

| | | | |
|---|---|---|---|
| 3,871,762 | 3/1975 | Van Der Vlasakker | 355/299 X |
| 3,927,936 | 12/1975 | Komori et al. | 355/299 |
| 4,131,358 | 12/1978 | Windele | 355/274 |
| 4,947,214 | 8/1990 | Baxendell et al. | 355/274 |
| 5,005,051 | 4/1991 | Haruki et al. | 355/274 X |
| 5,179,417 | 1/1993 | Sugaya et al. | 355/274 X |
| 5,233,395 | 8/1993 | Kohyama | 355/274 |
| 5,249,022 | 9/1993 | Watanabe et al. | 355/274 X |

*Primary Examiner*—Fred L. Braun

*Attorney, Agent, or Firm*—Hill, Steadman & Simpson

[57] ABSTRACT

A transfer station for an electrographic printer that can be operated in tandem mode for both-sided printing of an elongate recording medium contains a pressure element in the transfer region, the pressure element resiliently pressing the recording medium against the photoconductive drum over its width at least during the transfer process and thereby compensating irregularities of the recording medium. It is constructed multilayer of a plastic foil having a metal foil arranged thereon, this serving the purpose of picking up and eliminating electrostatic charges that occur in the contact region with the recording medium. The caries effect in transfer printing is thereby prevented. The pressure element is replaceably arranged in a holder as a wear part.

10 Claims, 3 Drawing Sheets

TRANSFER STATION WITH PRESSURE ELEMENT FOR AN ELECTROGRAPHIC PRINTER OR COPIER MEANS

BACKGROUND OF THE INVENTION

The invention is directed to a transfer station for an electrographic printer or copier means having a pressure element for the recording medium arranged in the transfer region.

Two-sided, electrographic printing of an elongate recording medium is disclosed, for example, in U.S. Pat. No. 5,179,417 which discloses that two printers be operated in tandem mode. The printers are thereby connected following one another, whereby the first printer of the arrangement prints the front side and the second printer prints the back side of the recording medium. Among other things, each printer contains a transfer station for transferring loose toner images from a photoconductive drum onto the recording medium and also contains a thermal fixing station in which the loose toner image is fixed on the recording medium by the influence of pressure and heat.

In the thermal fixing process, the recording medium, which is usually composed of paper, is conducted through the printer between a heated fixing drum and a pressure roller, where the toner image is heated and is fused into the recording medium. The paper is thereby heated up into the range of 200° C. This leads to a shrinkage of the paper due to gas evolution and may potentially result in local warping and deformation. Since, in tandem printing mode, the recording medium again passes through the transfer station in the second printer for printing the back side, such warpings have a negative influence on the transfer quality. The paper does not have its entire width lying against the photoconductive drum during transfer printing, as a result a local deficient transfer of the tonal particles in the transfer region can occur.

Such electrographic printer equipment are often operated with pre-folded continuous stock having a great variety of paper weights and formats. It is thereby desirable to potentially print the individual sheets up to the region of the fold. The elevations and warping of the fold likewise have a negative effect on the transfer process.

In order to reduce, among other things, the negative influence of such warping of the recording medium on the transfer printing quality, said U.S. Pat. No. 5,179,417 discloses that a one-piece paper pressure element of plate-shaped polyamide plastic be arranged in the transfer region. A paper pressure element fashioned in this way has the disadvantage that it is difficult to compensate small local elevations and warps. Moreover, it is contaminated by paper abrasion and the like. Since the element is rigidly joined to the transfer station, the entire transfer station must be taken apart in case of malfunction given damage or contamination.

It has been observed surprisingly that such a pressure element allows a "caries effect" to occur in the transfer of the toner images. A letter or a line is thereby not completely transferred and white, uninked regions remain within the characters or surfaces. This effect is shown in FIG. 7. Reference 31 thereby indicates the printed character and reference 32 indicates the white, uninked blank locations.

The inventor has discovered that the electrostatic charging of the paper in the region of the pressure element is the reason for this effect.

SUMMARY OF THE INVENTION

It is therefore an object of the invention to fashion a service-friendly transfer station for an electrographic or copier means such that recording mediums having local warping can also be reliably processed with high transfer quality without the occurrence of a caries effect.

This object is achieved by providing a transfer station for an electrographic printer or copier means having means for transferring a toner image produced on an electrographic intermediate carrier onto an elongate recording medium in a transfer region of the transfer station; guide means for the recording medium allocated to the transfer region and having a pressure element that smooths and resiliently presses the recording medium against the electrographic intermediate carrier over its width at least during the transfer process, the pressure element comprising means that pick-up and eliminate electrostatic charges of the recording medium at least in the region thereof which contacts the recording medium.

It is additionally advantageous to provide that the pressure element comprises an elastically fashioned pressure region that compensates local irregularities of the recording medium; the pressure element composed of electrically conductive material, at least in the region thereof which contacts the recording medium.

It is also advantageous to provide that the pressure element is constructed multi-layer and comprises a plastic layer having a metal layer arranged thereon. A holder can be provided that replaceably accepts the pressure element. The holder can comprise a spring element with spring regions that is displaceably arranged on fastening elements such that the pressure element presses against a receptacle surface in an integrated position of the spring element via the spring regions and releases the pressure element in a position shifted relative to the integration position.

A swivel means can be coupled to the pressure element, the swivel means being fashioned such that the pressure element presses the recording medium against the electrographic intermediate carrier in its swivelled-in condition and such that the recording medium is guided into a predetermined spacing from the electrographic intermediate carrier in the swivelled-out condition thereof.

Guide elements for the recording medium can be arranged at both sides of the transfer region and pivot the recording medium against and away from the electrographic intermediate carrier, whereby the pressure element is allocated to one of the guide elements.

The invention is also applicable to an electrographic printer means with which a recording medium that already comprises a toner image fixed on its back side is printed on its front side.

When a smooth pressure element that resiliently presses the recording medium against the photoconductive drum over its entire width during the transfer process is arranged in the transfer region of the transfer station, this pressure element having means at least in its region that contacts the recording medium that picks up and eliminates electrostatic charges of the recording medium, then it is possible to also process recording mediums that have local warping in the transfer station with high quality. Caries effects do not occur.

The invention makes it possible to offer transfer stations for electrographic printer equipment having a thermal fixing station that are in the position to process elongate recording mediums that already carry a toner image fixed on their back side. The invention is therefore particularly suitable for utilization in tandem printer equipment for both-sided printing of an elongate recording medium.

The pressure element that smooths the recording medium over its entire width in the region of the transfer station can be differently fashioned. What is thereby critical is the arrangement of an elastic pressure region that also compensates small local irregularities and the capability of the pressure element of eliminating electrostatic charges of the recording medium.

A sandwich-like structure of the pressure element has proven beneficial, having a plastic foil as carrier element with a metal foil arranged thereon. The elimination of the electrostatic charge thereby ensues via the grounded metal foil.

Due to the arrangement of the pressure element in a holder means that is easy to actuate, the pressure element fashioned as a wear part can be easily replaced without the transfer station having to be taken apart for this purpose.

It is also beneficial to arrange the pressure element directly on a pivotable paper saddle arranged at both sides of the transfer region. A separate swivel means for the pressure element is thus superfluous and a standard transfer station can be adapted within the scope of the invention without significant structural changes. The employment of a foil-like pressure element enables an easy matching to different recording medium widths by cutting off the regions that are not required. To this end, appropriate marks can be applied on the foil. The cutting can be carried out with a standard scissors. Embodiments of the invention are shown in the drawings and shall be set forth in greater detail below by way of example.

DETAILED DESCRIPTION OF THE PREFERRED EMBODIMENTS

Figure 1:
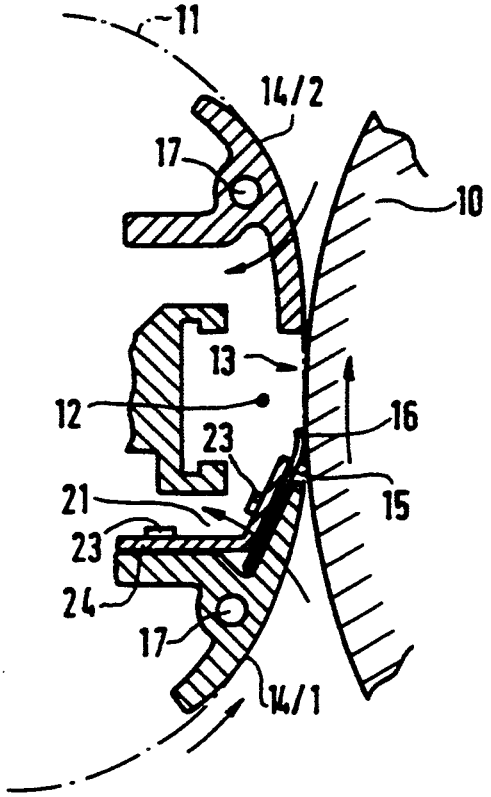
FIG. 1 is a schematic, sectional view of a transfer station having a pressure element for the recording medium arranged in the transfer region.
Figure 2:
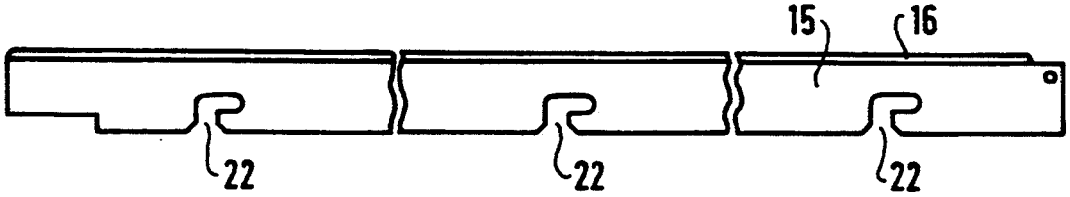
FIG. 2 is a schematic, side view of the pressure element.
Figure 3:
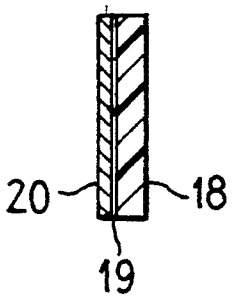
FIG. 3 is a schematic, sectional view of the pressure element.

An electrographic printer means, such as employed within the framework of a tandem arrangement of printers for the two-sided printing of a band-shaped recording medium is disclosed, for example, by U.S. Pat. No. 5,179,417. The printer means of the present invention contains a transfer station that is schematically shown in FIG. 1. The transfer station serves the purpose of transferring a toner image produced on a photoconductive drum 10 or on some other light-sensitive intermediate carrier onto an elongate recording medium 11 in the form, for example, of a smooth or pre-folded continuous stock.

This transfer ensues within the framework of electrographic process wherein the photoconductive drum 10 is first uniformly charged to approximately 500 V with the assistance of a charging means and is then discharged into the range of approximately 70 V with the assistance of an exposure means which is controlled character-dependent. A latent character image produced in this way is then inked in a standard way in a developer station with the assistance of a two-component mix composed of toner particles and ferromagnetic carrier particles.

The toner particles are triboelectrically positively charged. A field arises between a developer drum of the developer station, which lies at a bias potential of approximately 220 V, and the regions of the latent character image discharged to approximately 70 V, as a result whereof the toner particles agglomerate on the discharged regions. The toner particles are repelled from the non-exposed surface having a charging voltage of approximately 500 V. The toner image composed of loose toner particles produced in this way is then transferred onto the elongate recording medium 11 with the assistance of a highly negative electrostatic field generated via a transfer corotron 12. The transfer corotron 12 thereby acts through the recording medium 11, as a result thereof the toner particles are stripped from the photoconductive drum 10 and are transferred onto the recording medium that is situated in contact with the photoconductor 10. They electrostatically adhere thereto.

Subsequently, the toner images transferred in this way are fused into the surface of the recording medium 11 in a thermal printing fixing station between a heated fixing drum and a pressure roller. The remaining toner particles that still adhere to the photoconductive drum 10 after the transfer are removed in a standard way via a cleaning station. After this, the electrographic process begins anew by charging the photoconductive drum 10 via the charging station.

So that the elongate recording medium 11 can be brought into contact with or into the immediate proximity of the surface of the photoconductive drum 10, the transfer station contains guide means for the recording medium 11 in the form of two pivotable paper guide saddles 14/1, 14/2 that are arranged at both sides of a transfer region 13. The nature of the drive of these paper guide saddles 14/1, 14/2 and the appertaining conveyor means for the elongate recording medium 11 are not shown here for reasons of clarity; they are known from U.S. Pat. No. 4,131,358 and are disclosed in greater detail therein.

A pressure element 15 is arranged on the paper guide saddle 14/1 of the transfer station that is at the input side as seen in paper conveyor direction, this pressure element 15 extending over the entire width of the recording medium 11 and serving the purpose of locally pressing the elongate recording medium 11 against the surface of the photoconductive drum 10 during the transfer process over an optimally narrow pressure region 16.

The pivotable guide saddle 14/1 acts as a swivel means for positioning the pressure element 15 against the medium 11, or retracting the pressure element 15 from the medium 11.

Given interruption of the transfer operation, the recording medium 11 is brought to a defined distance from the surface of the photoconductive drum 10 by pivoting the paper guide saddles 14/1 and 14/2 around their pivot points 17. In this lifted-off condition, it is also possible to insert the recording medium 11 into the transfer station.

The pressure element 15 is fashioned as a thin, leaf-shaped element having a width of approximately 22 mm and a length corresponding to the width of the recording medium of, for example, 500 mm. It is constructed in layers and is essentially composed of a plastic foil 18 having a thickness of approximately 0.25 mm and of a metal foil 20 having a thickness of approximately 0.075 mm that is arranged on the plastic foil. For example, the plastic "Lexan 8030" serves as material for the plastic foil; the metal foil can be composed of nickel chromium steel (18Cr9Ni). Due to the layered structure of the pressure element in combination with the selection of materials, an especially elastic and abrasion-proof pressure region 16 having a width of less than 1 mm derives, local irregularities of the recording medium 11 being easily compensated thereover.

Figure 7:
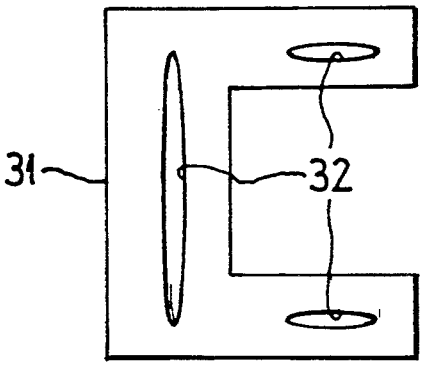
FIG. 7 is a schematic illustration of the caries effect in transfer printing.

The pressure element 15 is arranged such on the paper guide saddle 14/1 via a holder 21 that the metal foil 20 contacts the recording medium 11 in the pressure region 16, which should be as narrow as possible. As a result thereof, electrostatic charges arising in this pressure region 16 are picked up and eliminated via the metal foil 20 and the paper guide saddle 14/1 which is grounded for this purpose. These electrostatic charges are caused, for example, by friction between pressure element 15 and elongate recording medium 11 and due to the electrostatic field of the transfer corotron 12. When these charges are not eliminated, as has been surprisingly found, the charges lead to what is referred to as a caries effect in the transfer. Regions 32 of character surfaces 31 (FIG. 7) are thereby partially not transferred and white regions thus remain within the characters. These considerably deteriorate the print quality.

Pressure element 15 is fashioned as a wear part and can be easily replaced. It is interchangeably secured in the holder 21. To this end, the pressure element 15 comprises recesses 22 that interact with shanks of fastening screws. The holder 21 in the exemplary embodiment of FIG. 1 contains a bent spring steel sheet 24 that is secured on the paper guide saddle 14/1 via fastening screws 23 that engage in resilient, oblong holes of the spring steel sheet. The pressure element 15 is clamped between the spring steel sheet 24 and a receptacle surface 25 of the paper guide saddle 14/1; the fastening screws 23 thereby engage into the recesses 22 of the pressure element 15 via their shanks.

For replacing the pressure element in the exemplary embodiment shown in section in FIG. 1, the spring steel sheet 24 is first laterally displaced and, thus, the clamp connection in the region of the oblong holes is eliminated. The pressure element 15 can then be withdrawn from the shank region of the fastening screws 23 by dislocating the pressure element 15 in the detent region of the recesses 22. A new pressure element 15, which has been previously cut to correspond to the width of the recording medium employed, is then inserted into the described position between spring steel sheet 24 and receptacle surface 25 and is clamped in a fastened position by lateral displacement of the spring steel sheet 24.

The spring steel sheet 24 has a leg that laterally contacts the pressure element 15 and serves as a seating and supporting surface for the pressure element 15.

Figure 4:
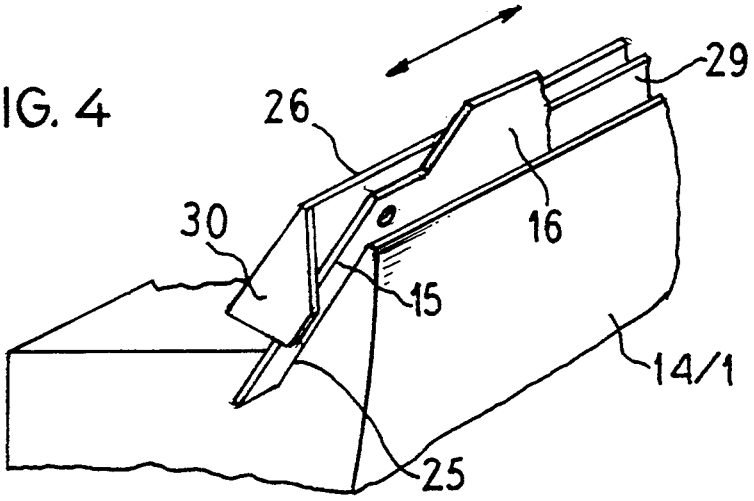
FIG. 4 is a schematic, perspective view of a holder that replaceably accepts the pressure element.
Figure 5:
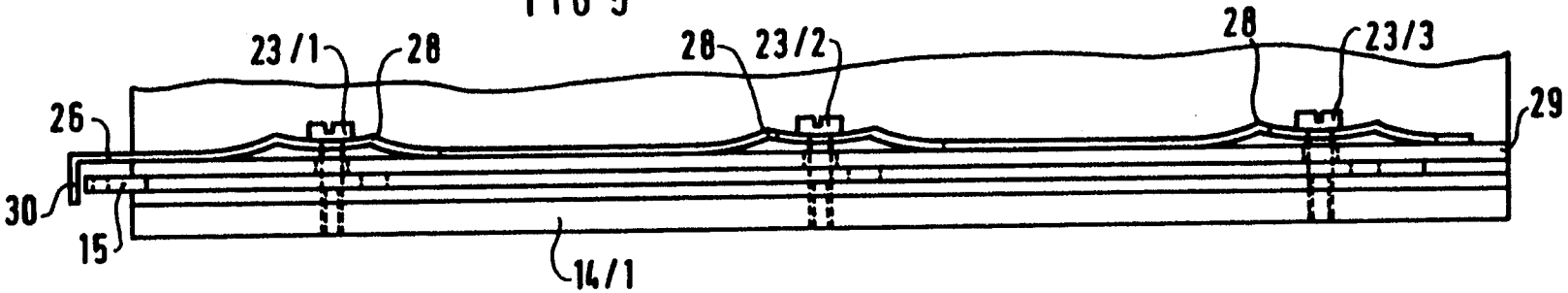
FIG. 5 is a plan view of the holder having built-in pressure element.
Figure 6:
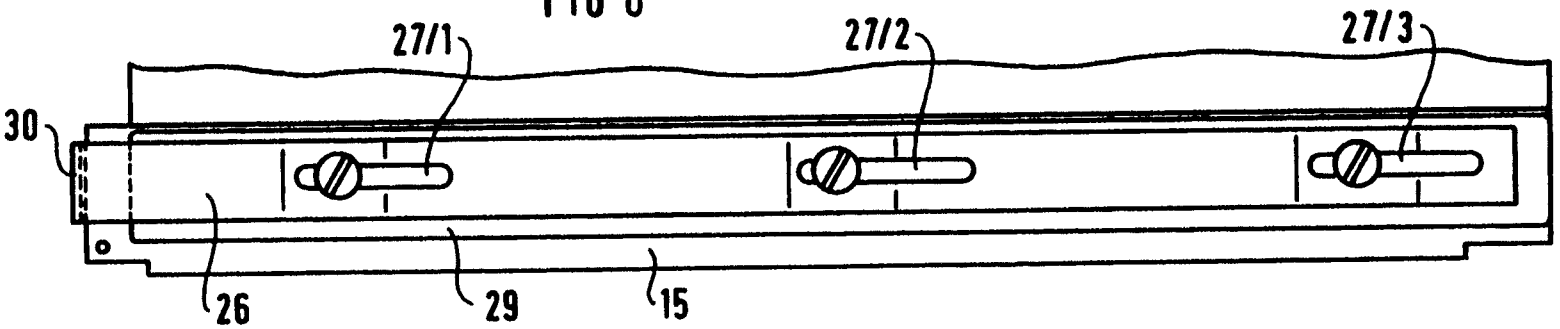
FIG. 6 is a back side view of the holder with built-in pressure elements.

In the embodiment of FIGS. 4 through 6, the holder 21 contains a spring band 26 having oblong holes 27/1, 27/2 and 27/3 arranged thereon for the acceptance of fastening screws 23/1, 23/2 and 23/3. The spring band 26 is bent in the region of the oblong holes 27/1, 27/2, 27/3 and forms spring regions 28 thereat which interact in latching fashion with the fastening screws 23/1, 23/2, 23/3. A support element 29 in the form of an aluminum sheet is located between spring band 26 and pressure element 15, this aluminum sheet having the job of supporting the pressure element 15 large-area in the region of the receptacle surface 25 of the saddle 14/1. The spring band 26 presses the supporting sheet 29 against the pressure element 15 via the spring regions 28 and thus locks it on the receptacle surface 25.

For releasing the clamped connection and, thus, for replacing the pressure element 15, the spring band 26 is pulled outward in arrow direction via a grasping projection 30 until detent of the oblong holes 27/2, 27/3. The pressure element 15 can then be removed from the holder by being displaced in its fastening openings 22 and a new pressure element 15 can be inserted. Thereafter, the spring band 26 is moved in reverse direction until detent of the oblong hole 27/1. The spring regions 28 are thus positioned under the heads of the fastening screws 23/1, 23/2, 23/3 in the assembled position.

In the illustrated exemplary embodiments, the pressure element is composed of a leaf-shaped element that is constructed multi-layer. However, it is also possible to fashion the pressure element in the form, for example, of a thin metallic brush or of a conductive, abrasion-proof plastic part that can be likewise fashioned leaf-shaped or is subdivided into individual, elastic sub-regions in the pressure region. A comb-like structure is also possible. Slots between the sub-regions, however, should be avoided since transfer problems as a consequence of the formation of caries can arise in their region. Dependent on the structure of the transfer station, it is also possible to provide a separate swivel means for the pressure element which can be actuated independently of the guide means for the recording medium.

Although the present invention has been described with reference to a specific embodiment, those of skill in the art will recognize that changes may be made thereto without departing from the scope and spirit of the invention as set forth in the appended claims.

We claim as our invention:

1. A transfer station for an electrographic printer or copier means, comprising:

means for transferring a toner image produced on an electrographic intermediate carrier onto an elongate recording medium in a transfer region of the transfer station;

guide means for the recording medium allocated to the transfer region and having a pressure element that smooths and resiliently presses the recording medium against the electrographic intermediate carrier over its width at least during the transfer process, said pressure element comprising means for picking up and eliminating electrostatic charges of the recording medium at least in a region of the pressure element which contacts the recording medium.

2. A transfer station according to claim 1, wherein the pressure element comprises an elastically fashioned pressure region that compensates local irregularities of the recording medium.

3. A transfer station according to claim 1 wherein said pressure element comprises an electrically conductive material.

4. A transfer station according to claim 1 wherein said pressure element comprises an electrically conductive surface at least in the region thereof which contacts the recording medium.

5. A transfer station according to claim 1 wherein said pressure element is constructed multi-layer and comprises a plastic layer having a metal layer arranged thereon.

6. A transfer station according to claim 1 comprising a holder that replaceably accepts the pressure element.

7. A transfer station according to claim 6, comprising a receptacle surface for supporting the pressure element, wherein the holder comprises a spring element with spring regions that is displaceably arranged on fastening elements such that the spring element presses the pressure element against the receptacle surface in an integrated position of the spring element via the spring regions and releases the pressure element in a position shifted relative to the integrated position.

8. A transfer station according to claim 1 having a swivel means coupled to the pressure element, said swivel means being fashioned such that the pressure element presses the recording medium against the electrographic intermediate carrier in its swivelled-in condition and such that the recording medium is guided into a predetermined spacing from the electrographic intermediate carrier in the swivelled-out condition thereof.

9. A transfer station according to claim 1 having guide elements for the recording medium that are arranged at both sides of the transfer region and pivot the recording medium against and away from the electrographic intermediate carrier, whereby the pressure element is allocated to one of the guide elements.

10. A transfer station according to claim 1 arranged in an electrographic printer means with which a recording medium that already comprises a toner image fixed on its back side is printed on its front side.

* * * * *